US005560818A

United States Patent [19]

Sharrow

[11] Patent Number: 5,560,818

[45] Date of Patent: Oct. 1, 1996

[54] ADJUSTABLE ORIFICE FOR GAS-SPARGED HYDROCYCLONE

[75] Inventor: Edward J. Sharrow, Queensbury, N.Y.

[73] Assignee: Ahlstrom Machinery Inc., Glens Falls, N.Y.

[21] Appl. No.: 305,691

[22] Filed: Sep. 13, 1994

[51] Int. Cl.[6] ..... B03D 1/24; B04C 5/16; B04C 5/181

[52] U.S. Cl. ..... 209/170; 209/730; 209/731; 209/733; 210/221.2; 210/512.3; 162/4

[58] Field of Search ..... 209/170, 727, 209/733, 730, 731; 162/4, 9; 210/512.1, 221.2, 703, 512.3

[56] References Cited

U.S. PATENT DOCUMENTS 4,744,890 5/1988 Miller .
4,838,434 6/1989 Miller .
5,069,751 12/1991 Chamblee et al. .
5,116,488 5/1992 Torregrossa .
5,131,980 7/1992 Chamblee et al. .
5,173,177 12/1992 Greenwood et al. .

*Primary Examiner*—Thomas M. Lithgow
*Attorney, Agent, or Firm*—Nixon & Vanderhye P.C.

[57] ABSTRACT

A conventional gas-sparged hydrocyclone, including a plug that cooperates with an interior surface of the hydrocyclone to adjust the size of an orifice defined adjacent the suspension outlet, is mechanically adjusted. The plug position is adjusted by a mechanical device from a position exteriorly of the hollow body while the hydrocyclone is running with suspension fed to its inlet, to effect direct linear movement of the plug with respect to the body interior surface. The mechanical elements include first and second pins and links within the hydrocyclone, a shaft having a drive portion extending exteriorly of the hydrocyclone, and a manually actuated link assembly or stepper motor for rotating the shaft. The manual actuator may be associated with an indexing arrangement to positively hold the plug at the position to which it has been adjusted.

17 Claims, 4 Drawing Sheets

ADJUSTABLE ORIFICE FOR GAS-SPARGED HYDROCYCLONE

BACKGROUND AND SUMMARY OF THE INVENTION

Gas-sparged hydrocyclones have become increasingly effective and popular for use in de-inking recycled paper pulp, removing "stickies" during pulp recycling, and for a number of other purposes. Basic features of the gas-sparged hydrocyclone for these purposes are shown in U.S. Pat. No. 5,173,177, the disclosure of which is hereby incorporated by reference herein. In conventional gas-sparged hydrocyclones, such as sold by Kamyr, Inc. of Glens Falls, N.Y., under the trademark GSC®, an orifice is defined inside the cyclone body between a plug and the surrounding cylindrical surface of the cyclone body. The flow rate of the hydrocyclone is controlled by adjusting the size of that orifice by movement of the plug, thereby controlling many of the operational parameters of the equipment.

The equipment for automatically regulating the orifice should the cyclone become clogged, such as shown in said U.S. Pat. No. 5,173,177, has not been successfully implemented, and the conventional GSC® hydrocyclones have an inconvenient mechanism for adjusting the orifice. In the conventional mechanisms, the hydrocyclone must be shut down before the orifice can be adjusted, a rubber boot must be removed so that a plug providing adjustment can be accessed, and a threaded cylinder must be rotated before the plug position can be adjusted. Then the rubber boot must be replaced before operation of the hydrocyclone can be initiated again.

According to the present invention, a hydrocyclone is provided with an effective mechanism and method for varying the accepts orifice size. The mechanism and method according to the present invention is convenient and inexpensive, and advantageously allows operation of the hydrocyclone as the orifice adjustment is being made. The invention thus results in a significant improvement in the operability and convenience of conventional hydrocyclones, such as GSC® hydrocyclones.

According to one aspect of the present invention, a hydrocyclone is provided having the following conventional components: A substantially hollow body having first and second ends and a wall disposed about an axis, and axially elongated. An inlet for introducing a suspension into the hollow body at the first end thereof so that the suspension flows in a vortex within the hollow body. A first outlet for withdrawing flowable material from adjacent the axis at the first end of the body. A porous surface of revolution disposed within the hollow body wall generally symmetrical with the axis, a plenum defined between the body wall and the porous surface of revolution. At least one fluid introduction opening for introducing fluid into the plenum to pass through the porous body of revolution into the vortex. A second outlet for withdrawing suspension from adjacent the second end of the body, the body having an interior surface adjacent the second outlet. And, a plug mounted adjacent the second end of the body, and having an exterior surface portion thereof positioned interiorly of the body interior surface, an orifice defined between the body interior surface and the plug exterior surface portion. According to the present invention, the hydrocyclone also includes mechanical means accessible from a position exteriorly of the hollow body for directly linearly moving the plug with respect to the body interior surface adjacent the second outlet to adjust the size of the orifice, the mechanical means operable even when the hydrocyclone is running with suspension fed to the inlet and fluid to so the fluid introduction opening.

The mechanical means preferably advantageously comprises the following elements: A first pin mounted to the plug. A first link having first and second ends and pivotally connected at the first end thereof to the first pin. A second pin. A second link having first and second portions. A shaft mounted for rotation with respect to the plug about an axis of rotation, and having a drive portion extending exteriorly of the hydrocyclone. The first link pivotally connected at the second end thereof to the second pin. The second link pivotally connected at the first portion thereof to the second pin. The second link rigidly connected at the second portion thereof to the shaft. And, a guide insuring linear movement of the plug in response to rotation of the shaft drive portion.

The hydrocyclone may further comprise: A third link rigidly connected to the drive portion of the shaft exteriorly of the hydrocyclone, and a handle connected to the third link facilitating pivotal movement of the third link to thereby effect rotation of the about the axis of rotation, and indexing means may be operatively connected to the third link for holding the third link in the position to which it has been moved. The indexing means typically includes human-readable indicia thereon relating various positions of the third link to the sizes of the orifices corresponding to the various positions of the third link.

Preferably, the indexing means comprises the following elements: A plate operatively stationarily mounted to the hollow body and having a plurality of openings therein. An index pin dimensioned to fit within the openings in the plate. And an opening in the third link, remote from the shaft, through which the index pin passes and with respect to which the index pin is movable from a first position in which the index pin is not within an opening in the plate and therefore the third link is pivotal, to a second position in which the index pin is within an opening in the plate and therefore the third link is not pivotal.

The plug may have a wide variety of configurations and still be eminently functional. In one embodiment of the plug according to the invention, the plug exterior surface comprises a tapered truncated cone, which cooperates with a substantially cylindrical interior surface of the hollow body. The plug may have a hollow interior, an open bottom to the hollow interior, and a closed top. The first pin may be mounted within the hollow interior of the plug along with at least part of the first lever. The shaft is exterior of the plug hollow interior and closer to the open bottom than to the closed top. The guide may comprise an interior surface of the plug defining the plug hollow interior, and a tube operatively stationarily mounted to the body. The shaft may be journalled by the tube for rotation, and the first and second links are typically disposed within the tube.

Instead of a manual drive provided by the third link/handle arrangement described above, the drive portion of the shaft may be connected to a stepper motor for effecting rotation thereof. The stepper motor may be controlled by a manual switch for effective drive (in either of two directions) thereof, or it may be controlled by a pressure or flow rate control means which operates the motor automatically in a response to a particular pressure or flow rate within the hollow body of the hydrocyclone.

The mechanical drive provided by the present invention is simple, inexpensive, and sturdy, with little to go wrong over time, while still providing positive adjustment of the orifice size including when the hydrocyclone is running.

The invention also relates to a method of operation a hydrocyclone. The method comprises the following steps:

(a) Introducing a paper pulp suspension having a consistency of about 4% or less into the inlet so that the suspension flows in a vortex with the hollow body.

(b) Withdrawing accepts flowable material from the first outlet.

(c) Introducing a fluid into the fluid introduction opening to pass through the porous body of revolution into the vortex.

(d) Withdrawing suspension through the second outlet.

And (e) from a position exteriorly of the hollow body, while steps (a) through (d) are being practiced, directly mechanically linearly moving the plug with respect to the body interior surface to adjust the size of the orifice.

It is the primary object of the present invention to provide a convenient and inexpensive mechanical drive and method for varying the size of the accepts orifice for a hydrocyclone. This and other objects of the invention will become clear from an inspection of the detailed description of the invention and from the appended claims.

DETAILED DESCRIPTION OF THE DRAWINGS

Figure 1:
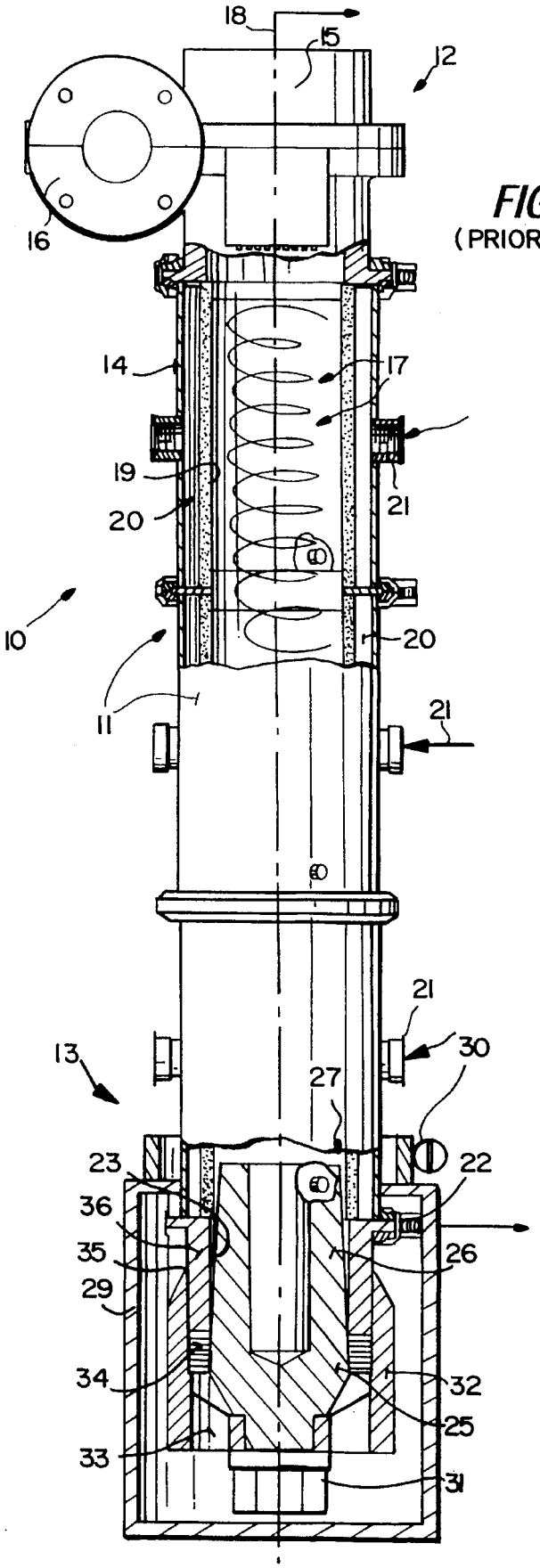
FIG. 1 (PRIOR ART)
FIG. 1 is a side view, partly in cross section and partly in elevation, showing an exemplary prior art gas-sparged hydrocyclone.

A conventional gas-sparged hydrocyclone, such as sold by Kamyr, Inc. under the trademark GSC®, is shown generally by reference numeral 10 in FIG. 1. It includes a substantially hollow body 11 having a first end 12 and a second end 13 and a wall 14 disposed about a central axis 15 (which typically is vertical in operation but can have other orientations), the housing body 11 being axially elongated. An inlet 16 is provided for introducing a suspension (such as recycled paper pulp as disclosed in U.S. Pat. Nos. 5,069,751 and 5,131,980, the disclosures of which are hereby incorporated by reference herein) at the first end 12 thereof so that the suspension flows in a vortex—shown schematically at 17 in FIG. 1—within the body 11. A first outlet 18 is provided for withdrawing flowable material, e.g., rejects such as ink particles, stickies, and the like, typically in a foam physical configuration, from the first end 12 of the body.

A porous surface of revolution 19 is disposed within the body 11 and is generally symmetrical with the axis 15. A plenum 20 is defined between the body wall 14 and the porous surface of revolution 19. At least one (and typically a plurality of) fluid introduction openings, shown schematically at 21 in FIG. 1, are provided for the introduction of fluid (typically gas) into the plenum 20 to pass through the porous body of revolution 19 into the vortex 17. A second outlet 22 for withdrawing suspension "accepts", such as accepted paper pulp (with ink and stickies removed) from adjacent the second end 13 of the body 11, is also provided, the accepts flow indicated schematically by the arrow coming from element 22 in FIG. 1. The body has an interior surface—such as the cylindrical surface 23—adjacent the second end 13.

A plug 25 is also mounted adjacent the second end 13 of the body 11, and has an exterior surface portion 26 thereof positioned interiorly of the surface 23, within an orifice—shown generally by reference numeral 27—defined between the body interior surface 23 and the plug exterior surface portion 26. The surface 26 is—in the embodiment illustrated in FIG. 1—a truncated right circular cone, although other configurations can be utilized.

In the conventional hydrocyclone of FIG. 1, it is necessary to shut down operation of the hydrocyclone 10 before the orifice 27 size can be adjusted. After the hydrocyclone 27 is shut down, the rubber boot 29 is removed, as by disconnecting band clamp 30. The plug 25 is mounted to a threaded cylinder 32 by means of a spider type support 33. The cylinder 32 may be turned, the internal threads 34 thereof cooperating with the external threads 35 on the housing stationary cylinder 36 which defines the interior surface 23, and because of the taper of the external surface 26, the size of the orifice 27 is adjusted. The nut 31 attaches elements 32 and 25 together. Parts 25 and 31–33 rotate as a unit. Once the threaded cylinder 32 is rotated to either raise or lower the plug 25 so that the orifice 27 is at the desired size, the boot 29 is replaced.

As can be seen, the adjustment mechanism for the conventional hydrocyclone 10 is less than convenient. The invention overcomes this lack of convenience while at the same time providing an inexpensive, simple, and almost fail-safe mechanical actuator which can be actuated while the hydrocyclone is running.

Figure 2:
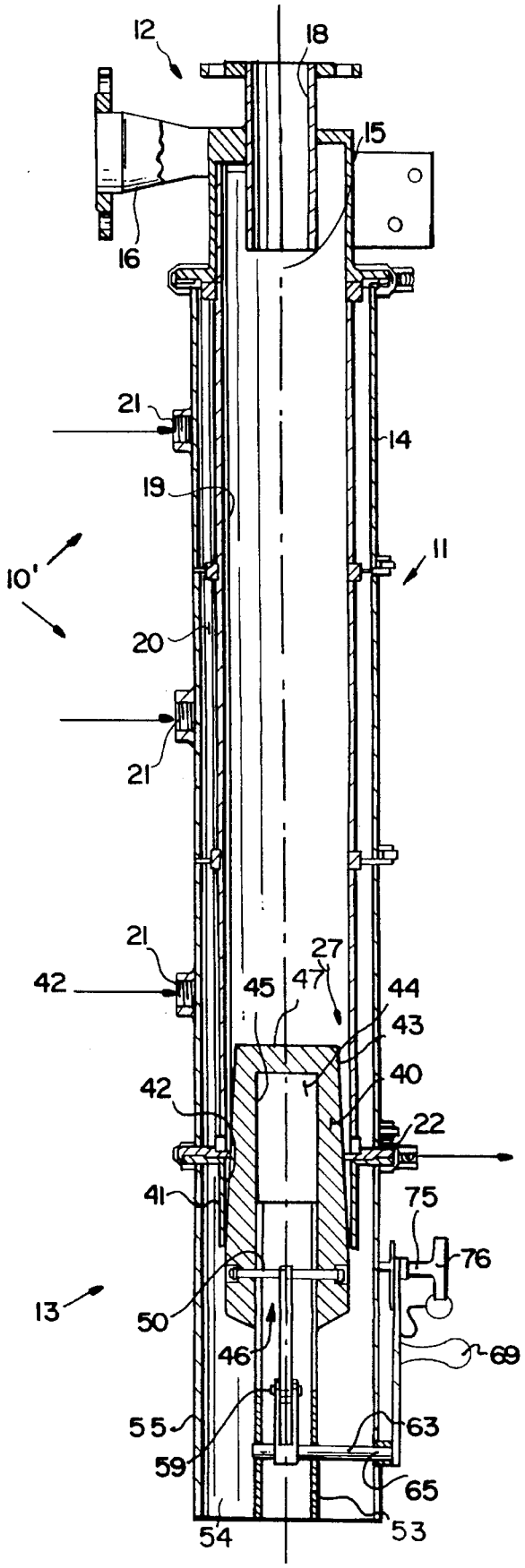
FIG. 2 is a side cross-sectional view of an exemplary hydrocyclone according to the present invention.

A hydrocyclone according to the present invention is shown by reference numeral 10' in FIG. 2. In FIG. 2 all of the components which are essentially identical to those in FIG. 1 are shown by the same reference numeral. What is different according to the present invention is primarily a mechanism for adjusting the position of the revised plug 40, although the plug 40 is slightly different than the plug 25 to accommodate the new adjustment mechanism, and stationary cylinder 41 defining the interior surface 42 for cooperating with the exterior surface 43 of the plug 40 is simplified compared to the hydrocyclone 10.

The preferred construction of the plug 40 according to the invention is illustrated most clearly in FIGS. 2 through 4 and 6. The exterior surface 43 thereof is preferably a truncated right circular cone, like the surface 26 of the conventional plug 25, although a wide variety of other surface configurations could be provided. Preferably, the plug 40 has a hollow interior 44, which may be defined by the interior generally cylindrical surface 45, the surface 45 being concentric with the axis 15. The hollow interior 44 has an open bottom, shown merely generally by reference numeral 46 in FIG. 2, and a closed top 47 (the terms "bottom", "top" merely being relative in assuming a vertical orientation of the plug 43, although other orientations are possible, the "top" merely being that end of the plug 40 closest to the inlet 16).

Figure 3:
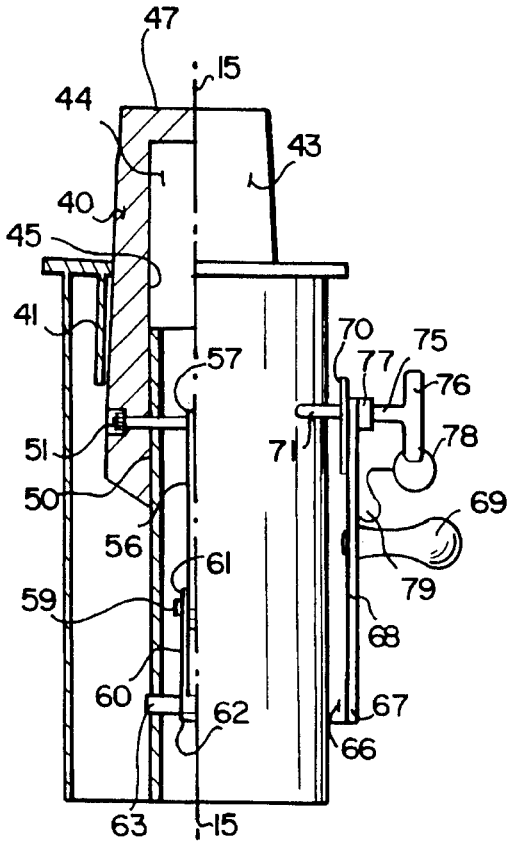
FIG. 3 is a side view, partly in cross section and partly in elevation, of just the plug and mechanical drive therefor of the hydrocyclone in FIG. 2.
Figure 5:
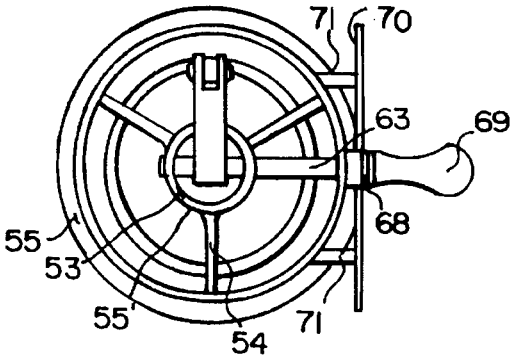
FIG. 5 is a bottom plan view of the plug and drive of FIGS. 3 and 4.
Figure 6:
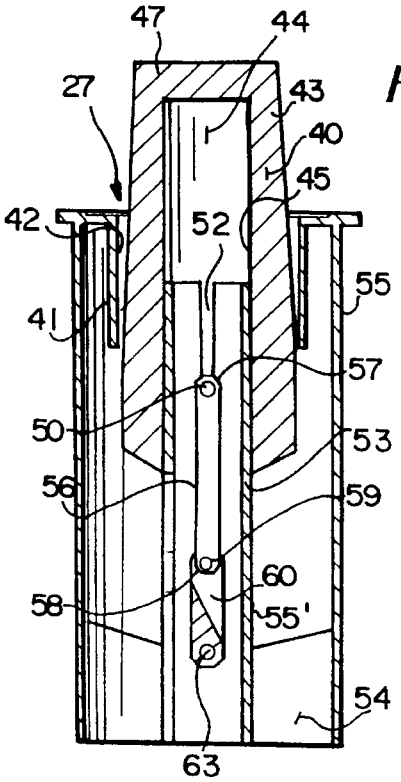
FIG. 6 is a rear cross-sectional view of the plug and drive of FIGS. 3 through 5.

The mechanical means accessible from a position exteriorly of the hollow body 11 for directly linearly moving the plug 40—along the axis 15—with respect to the body interior surface 42 to adjust the orifice 27 includes a first pin 50 which is mounted to the plug 40, as best seen in FIG. 3 where a nut 51 is shown on a threaded end of the pin 50 for holding it so that it moves up and down in the dimension of axis 15 with the plug 40. The pin 50 also may be received within a slot—see slot 52 in FIG. 6—in a tube 53 which is concentric with the axis 15. The tube 53 is stationarily mounted with respect to the body 11 as by the gussets 54 (see FIGS. 5 and 6) which are directly affixed to the interior surface of the cylindrical extension 55 of the body 11 and the exterior surface of tube 53. Note that the exterior surface 55' of the tube 53 engages the interior surface 45 of the hollow interior 44 of the plug 40, the surfaces 45, 55' providing a guide to ensure pure linear movement of the plug 40 in the dimension of access 15.

The mechanical mechanism for adjusting the position of the plug 40 further comprises a first link 56, which typically comprises a single bar pivotally connected at first end 57 thereof to the first pin 50, and pivotally connected at a second end 58 thereof to a second pin 59. At the second end 58 thereof, the first link 56 is straddled by the bifurcated second link 60, which is also pivotally connected at a first end 61 thereof to the second pin 59, and is rigidly connected at a second portion (typically end) 62 thereof to a shaft 63. The shaft 63 extends substantially perpendicular to the axis 15 (typically horizontal when the axis 15 is vertical) and is journalled by the tube 53 where it passes through the tube 53. Normally, separate journalling bearings are not necessary, although they may be provided.

The shaft 63 has a drive portion 65 thereof (see FIG. 2) which is accessible from the exterior of the hydrocyclone body 11. In the embodiment illustrated in FIGS. 2 through 6, the drive portion 65 rotates in a collar 66 (see FIG. 3) at a first end 67 of the third lever 68. The collar 66 is attached to housing 55, and is stationary. Preferably a handle 69, which facilitates pivotal movement of the third link 68, is connected to the third link 68 remote from the first end 67 thereof.

The manual mechanism illustrated in FIGS. 2 through 6 also preferably comprises indexing means for holding the third link 68 into the position to which it has been pivoted. The indexing means preferably comprises a plate 70 (see FIGS. 3 through 5 in particular) which is rigidly affixed—as by posts 71—to the housing extension 55. The plate 70 has a plurality of openings 72 (see FIG. 4) formed therein, typically on both sides of the center position of the link 68 illustrated in FIG. 4. Preferably human-readable indicia 73 are associated with each of the openings 72, the indicia 73 relating various positions of the third link 68 to the sizes of the orifices 27 corresponding to the various positions of the third link 68. The indicia 73 may be actual sizes (e.g., the maximum width of the orifice 27), or may be keyed to the flow rates that might be expected from those positions.

The indexing means further comprises index pin 75 (see FIGS. 2 and 3) preferably connected to a handle 76. The pin 75 is dimensioned so that at least the end thereof distal from the handle 76 fits within the opening 72. Also, the pin 75 is dimensioned to pass through an opening defined by the collar 77 (see FIG. 3) in the second end of the link 68 opposite the first end 67 thereof. To prevent detachment of the pin 75 from the entire mechanism, and subsequent loss thereof, if it is completely removed from the opening defined by collar 77, a ring 78 may be connected to the handle 76, and a wire or chain 79 connected to both the ring 78 and the link 68.

A typical utilization of the hydrocyclone 10', if it is determined that a higher flow rate of accepts suspension is desired, is as follows:

While the hydrocyclone 10' is still operating, a human operator grasps the handle 76 of the index pin 75 and withdraws it from the opening 72 in plate 70 with which it is associated. Then, by grasping the handle 69 of the third link 68, the human operator pivots the link 68 about the axis defined by shaft 63. This pivotal action of the link 68—counter-clockwise in FIG. 4—results in rotation of the shaft 63, which in turn results in rotation of the second link 60, which causes the second pin 59 to move downwardly, causing the first link 56 to also move slightly downwardly, due to the connection thereof to the first pin 50 which is connected to the plug 40, causing a slight downward movement of the plug 40. The movement is completely linear because the guide surfaces 45, 55' allow only movement along the dimension of the axis 15. By reading the indicia 73 which indicates the position of the plug 40, and thus the size of the orifice 27, that is desired, the human operator then pushes in on the handle 76 of index pin 75, causing it to enter the appropriate opening 72 in the plate 70, and remain in that position.

Figure 4:
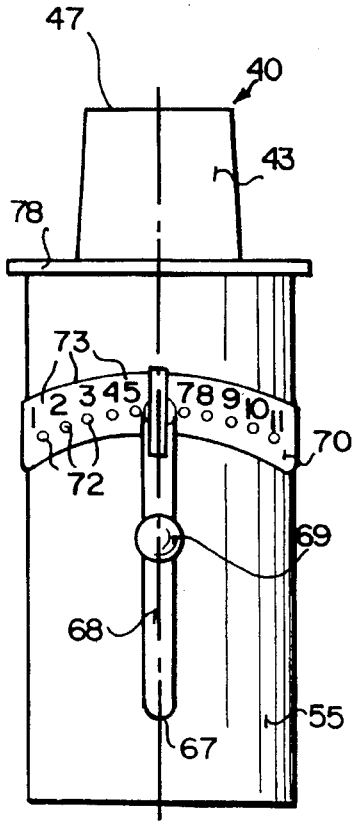
FIG. 4 is a front elevational view of the plug and drive of FIG. 3.

If it is desired to make the orifice 27 smaller, the operator repeats the above operation only pivoting the third link 68 clockwise about the shaft 63, as viewed in FIG. 4.

[It is noted that in FIG. 2 the handle 69 is shown in a vertical midrange position and the plug 40 in the full upright position, for ease of illustration. However in actuality the handle 69 will be fully clockwise when the plug 40 is in the position illustrated in FIG. 2.]

The mechanical actuator of FIGS. 2 through 6—as most clearly seen in FIGS. 3 through 6—may comprise a self-contained integral unit which may be retrofit into existing hydrocyclones, merely by connection of a flange 78 thereof (see FIG. 4) to a cooperating existing flange on an existing GSC® hydrocyclone. That is, it may merely be substituted for the plug 25 and associated components of the conventional hydrocyclone 10 illustrated in FIG. 1.

Figure 7:
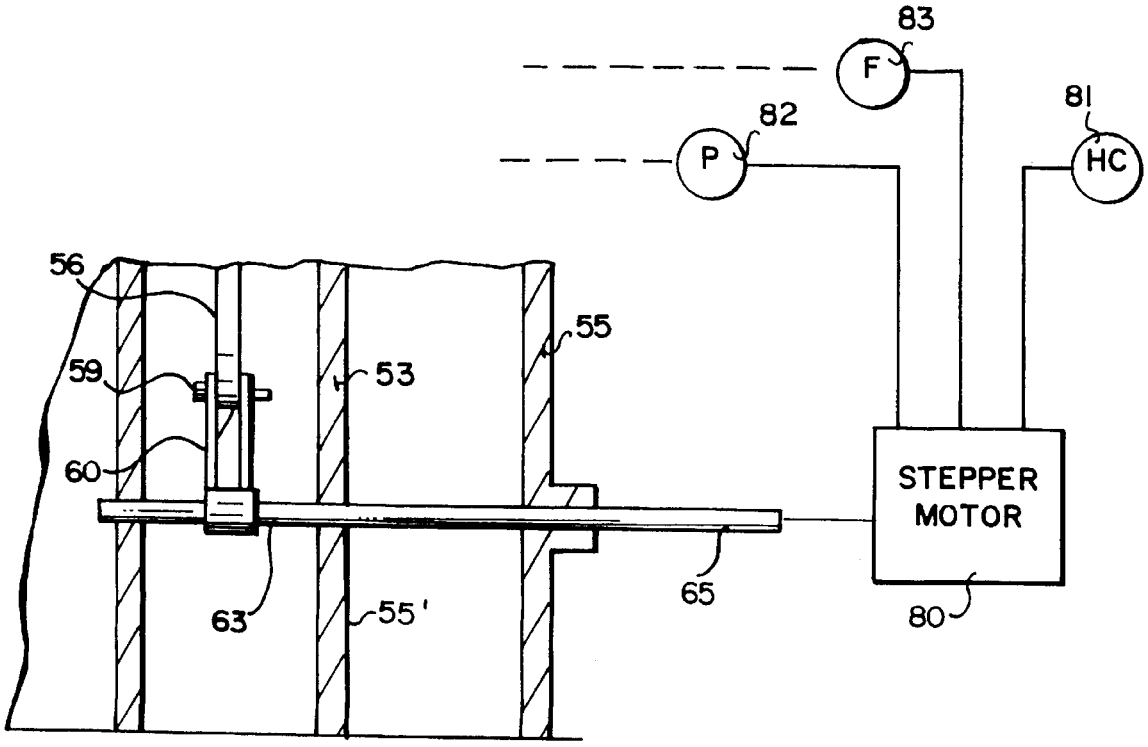
FIG. 7 is a detailed schematic view illustrating an alternative operating element for rotating the shaft of the mechanical plug adjustment structure of FIGS. 2 through 6.

While the manual actuation provided by the third link 68 and associated components as illustrated in FIGS. 2 through 6 is the simplest form of the invention, the shaft 63 may be operated in other manners too. For example—as illustrated in FIG. 7—the drive portion 65 of shaft 63 that is exterior of the housing extension 55 may be connected up to a conventional stepper motor 80. The motor 80 may be operated, to control how many steps it takes in each direction, by the hand operated switch 81, or it may be automatically operated by a pressure controller 82 or flow controller 83. The pressure controller 82 and the flow controller 83 may sense the pressure or the flow rate, respectively, within body 11 or in the accepts or rejects conduits, and control the stepper motor 80 to automatically change the size of the orifice 27 [e.g., rotating shaft 63 to make the orifice 27 larger if the flow rate gets too low or the pressure too high].

It will thus be seen that according to the present invention an advantageous hydrocyclone, particularly an orifice adjusting mechanism thereof, as well as a method of operation of the hydrocyclone to allow adjustment of the accepts orifice size, even while the hydrocyclone is operating, have been provided which are highly advantageous, convenient, inexpensive and simple.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and processes.

What is claimed is:

1. A hydrocyclone, comprising:

a substantially hollow body having first and second ends and a wall disposed about an axis, and elongated along said;

an inlet for introducing a suspension into said hollow body at said first end thereof so that the suspension flows in a vortex within said hollow body;

a first outlet for withdrawing flowable material from adjacent said axis at said first end of said body;

a porous surface of revolution disposed within said hollow body wall generally symmetrical with said axis, a plenum defined between said body wall and said porous surface of revolution;

at least one fluid introduction opening for introducing fluid into said plenum to pass through said porous body of revolution into the vortex;

a second outlet for withdrawing suspension from adjacent said second end of said body, said body having an interior surface adjacent said second outlet;

a plug mounted adjacent said second end of said body, and having an exterior surface portion thereof positioned interiorly of said body interior surface, an orifice defined between said body interior surface and said plug exterior surface portion;

mechanical means accessible from a position exteriorly of said hollow body for directly linearly moving said plug with respect to said body interior surface adjacent said second outlet to fix the position of said plug and thereby adjust the size of said orifice, said mechanical means operable even when said hydrocyclone is running with suspension fed to said inlet and fluid to said fluid introduction opening; and wherein said mechanical means comprises: a first pin mounted to said plug; a first link having first and second ends and pivotally connected at said first end thereof to said first pin; a second pin; a second link having first and second portions; a shaft mounted for rotation with respect to said plug about an axis of rotation, and having a drive portion extending exteriorly of said hydrocyclone; said first link pivotally connected at said second end thereof to said second pin; said second link pivotally connected at said first portion thereof to said second pin; said second link rigidly connected at said second portion thereof to said shaft; and a guide insuring linear movement of said plug in response to rotation of said shaft drive portion.

2. A hydrocyclone as recited in claim 1 further comprising a third link rigidly connected to said drive portion of said shaft exteriorly of said hydrocyclone, and a handle connected to said third link facilitating pivotal movement of said third link to thereby effect rotation of said shaft about said axis of rotation.

3. A hydrocyclone as recited in claim 2 further comprising indexing means operatively connected to said third link for holding said third link in a position to which it has been moved.

4. A hydrocyclone as recited in claim 3 wherein said indexing means includes human readable indicia thereon relating various positions of said third link to the sizes of said orifice corresponding to the various positions of said third link.

5. A hydrocyclone as recited in claim 3 wherein said indexing means comprises: a plate operatively stationarily mounted to said hollow body and having a plurality of openings therein; an index pin dimensioned to fit within said openings in said plate; and an opening in said third link, remote from said shaft, through which said index pin passes and with respect to which said index pin is movable from a first position in which said index pin is not within an opening in said plate and therefore said third link is pivotal, to a second position in which said index pin is within an opening in said plate and therefore said third link is not pivotal.

6. A hydrocyclone as recited in claim 1 wherein said plug exterior surface comprises a tapered truncated cone and said interior surface of said hollow body is substantially cylindrical.

7. A hydrocyclone as recited in claim 6 wherein said plug has a hollow interior, an open bottom to said hollow interior, and a closed top; and wherein said first pin and at least a portion of said first lever are disposed within said hollow interior of said plug; and wherein said shaft is exterior of said plug hollow interior and closer to said open bottom than to said closed top thereof.

8. A hydrocyclone as recited in claim 7 wherein said guide comprises an interior surface of said plug defining said plug hollow interior, and a tube operatively stationarily mounted to said body, said shaft journalled by said tube for rotation, and said first and second levers disposed within said tube.

9. A hydrocyclone as recited in claim 1 further comprising a stepper motor connected to said shaft drive portion for effecting rotation thereof.

10. A hydrocyclone as recited in claim 9 further comprising pressure or flow rate control means for controlling operation of said stepper motor in response to a particular pressure or flow rate within said hollow body.

11. A hydrocyclone, comprising:

a substantially hollow body having first and second ends and a wall disposed about an axis, and elongated along said axis;

an inlet for introducing a suspension into said hollow body at said first end thereof so that the suspension flows in a vortex within said hollow body;

a first outlet for withdrawing flowable material from adjacent said axis at said first end of said body;

a porous surface of revolution disposed within said hollow body wall generally symmetrical with said axis, a plenum defined between said body wall and said porous surface of revolution;

at least one fluid introduction opening for introducing fluid into said plenum to pass through said porous body of revolution into the vortex;

a second outlet for withdrawing suspension from adjacent said second end of said body, said body having an interior surface adjacent said second outlet;

a plug mounted adjacent said second end of said body, and having an exterior surface portion thereof positioned interiorly of said body interior surface, an orifice defined between said body interior surface and said plug exterior surface portion; and a mechanical drive for directly linearly moving said plug with respect to said body interior surface adjacent said second outlet to control the size of said orifice, said drive comprising: a first pin mounted to said plug; a first link having first and second ends and pivotally connected at said first end thereof to said first pin; a second pin; a second link having first and second portions; a shaft mounted for rotation with respect to said plug about an axis of rotation, and having a drive portion extending exteriorly of said hydrocyclone; said first link pivotally connected at said second end thereof to said second pin; said second link pivotally connected at said first portion thereof to said second pin; said second link rigidly connected at said second portion thereof to said shaft; and a guide insuring linear movement of said plug in response to rotation of said shaft drive portion.

12. A hydrocyclone as recited in claim 11 further comprising a third link rigidly connected to said drive portion of said shaft exteriorly of said hydrocyclone, and a handle connected to said third link facilitating pivotal movement of said third link to thereby effect rotation of said shaft about said axis of rotation.

13. A hydrocyclone as recited in claim 12 further comprising indexing means operatively connected to said third link for holding said third link in a position to which it has been moved, and wherein said indexing means includes human readable indicia thereon relating various positions of said third link to the sizes of said orifice corresponding to the various positions of said third link.

14. A hydrocyclone as recited in claim 13 wherein said indexing means comprises: a plate operatively stationarily mounted to said hollow body and having a plurality of openings therein; an index pin dimensioned to fit within said openings in said plate; and an opening in said third link, remote from said shaft, through which said index pin passes and with respect to which said index pin is movable from a first position in which said index pin is not within an opening in said plate and therefore said third link is pivotal, to a second position in which said index pin is within an opening in said plate and therefore said third link is not pivotal.

15. A hydrocyclone as recited in claim 11 wherein said plug has a hollow interior, an open bottom to said hollow interior, and a closed top; and wherein said first pin and at least a portion of said first lever are disposed within said hollow interior of said plug; and wherein said shaft is exterior of said plug hollow interior and closer to said open bottom than to said closed top thereof.

16. A hydrocyclone as recited in claim 11 wherein said guide comprises an interior surface of said plug defining said plug hollow interior, and a tube operatively stationarily mounted to said body, said shaft journalled by said tube for rotation, and said first and second levers disposed within said tube.

17. A hydrocyclone as recited in claim 11 further comprising a stepper motor connected to said shaft drive portion for effecting rotation thereof.

* * * * *